US006416403B1

(12) United States Patent
Chiang

(10) Patent No.: US 6,416,403 B1
(45) Date of Patent: Jul. 9, 2002

(54) GRINDING DEVICE WITH DUST COLLECTING MECHANISM

(76) Inventor: Pei-Lieh Chiang, No. 12, Nan-Ping Rd., Nan Dist., Taichung (TW)

( * ) Notice: Subject to any disclaimer, the term of this patent is extended or adjusted under 35 U.S.C. 154(b) by 0 days.

(21) Appl. No.: 09/929,180

(22) Filed: Aug. 14, 2001

(30) Foreign Application Priority Data

Jun. 20, 2001 (TW) ..... 90210407 U

(51) Int. Cl.[7] ..... B24B 55/04
(52) U.S. Cl. ..... 451/453; 451/451; 451/178
(58) Field of Search ..... 451/178, 190, 451/453, 451, 452, 455, 457; 144/252.1

(56) References Cited

U.S. PATENT DOCUMENTS 4,805,353 A * 2/1989 Keith et al. ..... 51/273
5,591,075 A * 1/1997 Chang ..... 451/451

* cited by examiner

*Primary Examiner*—Timothy V. Eley
*Assistant Examiner*—Dung Van Nguyen
(74) *Attorney, Agent, or Firm*—Ladas & Parry

(57) ABSTRACT

A grinding device includes a grinding wheel member driven by an output shaft of a motor. A drive transmission member transmits the driving force of the output shaft to a rotating shaft to operate a blowing member when the motor is actuated. A dust collecting member is disposed in the vicinity of the grinding wheel member for collecting dust during a grinding operation. An elongated hollow member is disposed between the collecting member and the blowing member so as to draw dust from the collecting member to the blowing member.

6 Claims, 5 Drawing Sheets

GRINDING DEVICE WITH DUST COLLECTING MECHANISM

CROSS-REFERENCE TO RELATED APPLICATION

This application claims priority of Taiwan patent Application No. 090210407, filed on Jun. 20, 2001.

BACKGROUND OF THE INVENTION

1. Field of the Invention

This invention relates to a grinding device, more particularly to a grinding device with a dust collecting mechanism which is driven by a motor thereof.

2. Description of the Related Art

Referring to FIG. 1, a conventional grinding device 10 is shown to include a motor 11 with an output shaft (not shown), two grinding wheels 12 which are mounted to rotate with two ends of the output shaft, and two dust chutes 13 which are disposed to surround and which are spaced apart from the grinding wheels 12. Since a large amount of dust is formed and scatters during a grinding operation of the grinding device 10, collecting means is needed to collect the dust.

SUMMARY OF THE INVENTION

The object of the present invention is to provide a grinding device which has a dust collecting mechanism to collect dust during operation.

According to this invention, the grinding device includes a motor with an output shaft to deliver a driving force. The output shaft defines a first axis, and extends in a longitudinal direction. A grinding wheel member is mounted to rotate with the output shaft about the first axis. A rotating shaft defines a second axis parallel to the first axis, and has inner and outer ends opposite to each other in the longitudinal direction. A drive transmission member is disposed to transmit the driving force of the output shaft to the outer end of the rotating shaft. A dust collecting member is disposed in the vicinity of and is spaced apart from the grinding wheel member to collect dust, and has an outlet port. An elongated hollow member defines a duct therethrough, and has a first tubular end which is connected to the dust collecting member such that the duct is communicated with the outlet port, a second tubular end, and a middle portion which is disposed between the first and second tubular ends. A blowing member includes a casing and an impeller. The casing has proximate and distal walls which are spaced apart from each other in the longitudinal direction and which are respectively proximate and distal to the rotating shaft to confine an accommodating chamber, and a discharge port which is disposed between the proximate and distal walls and which extends radial to the second axis. The distal wall is provided with an inlet port which is connected to and communicated with the second tubular end of the hollow member. The proximate wall is mounted on the inner end of the rotating shaft to permit rotation of the inner end relative thereto. The impeller is received in the accommodating chamber, and is driven by the inner end of the rotating shaft to rotate about the second axis so as to draw dust from the dust collecting member to the accommodating chamber via the duct and out of the discharge port.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
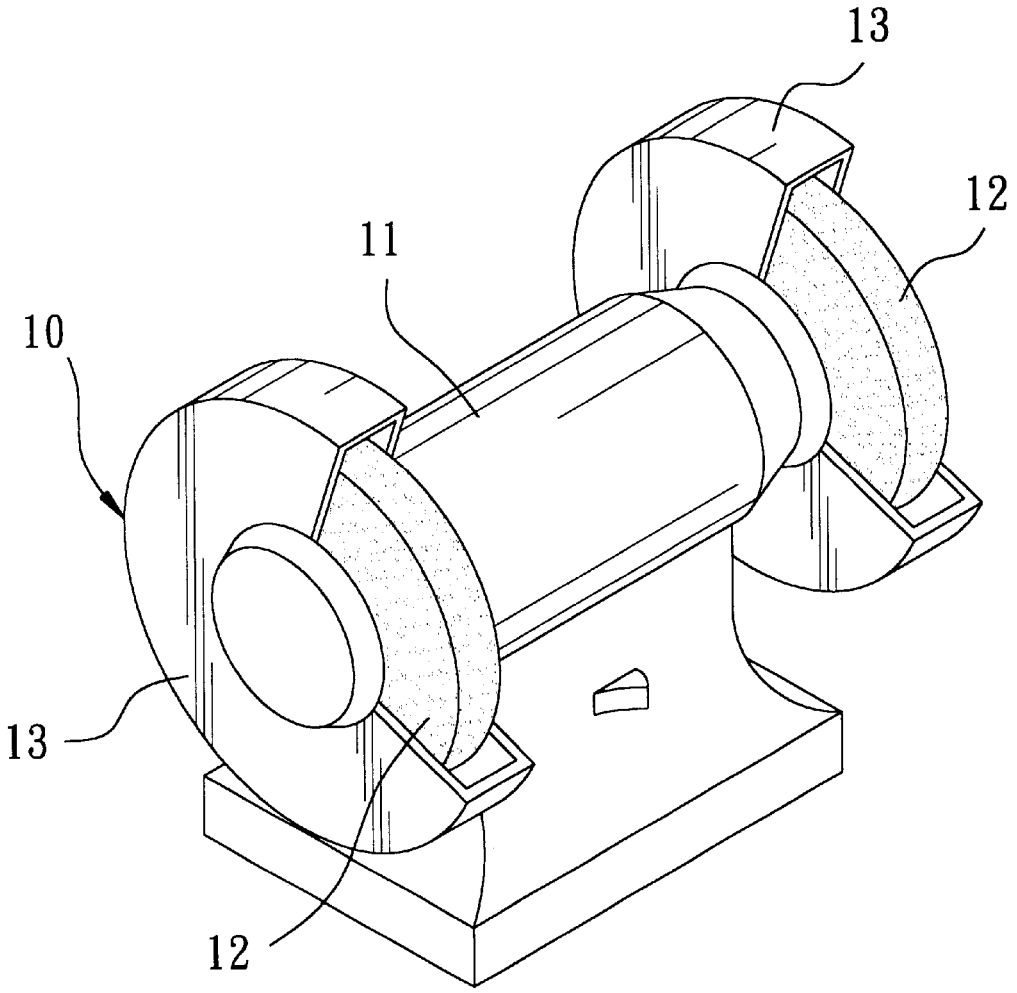
FIG. 1 PRIOR ART
FIG. 1 is a perspective view of a conventional grinding device.
Figure 2:
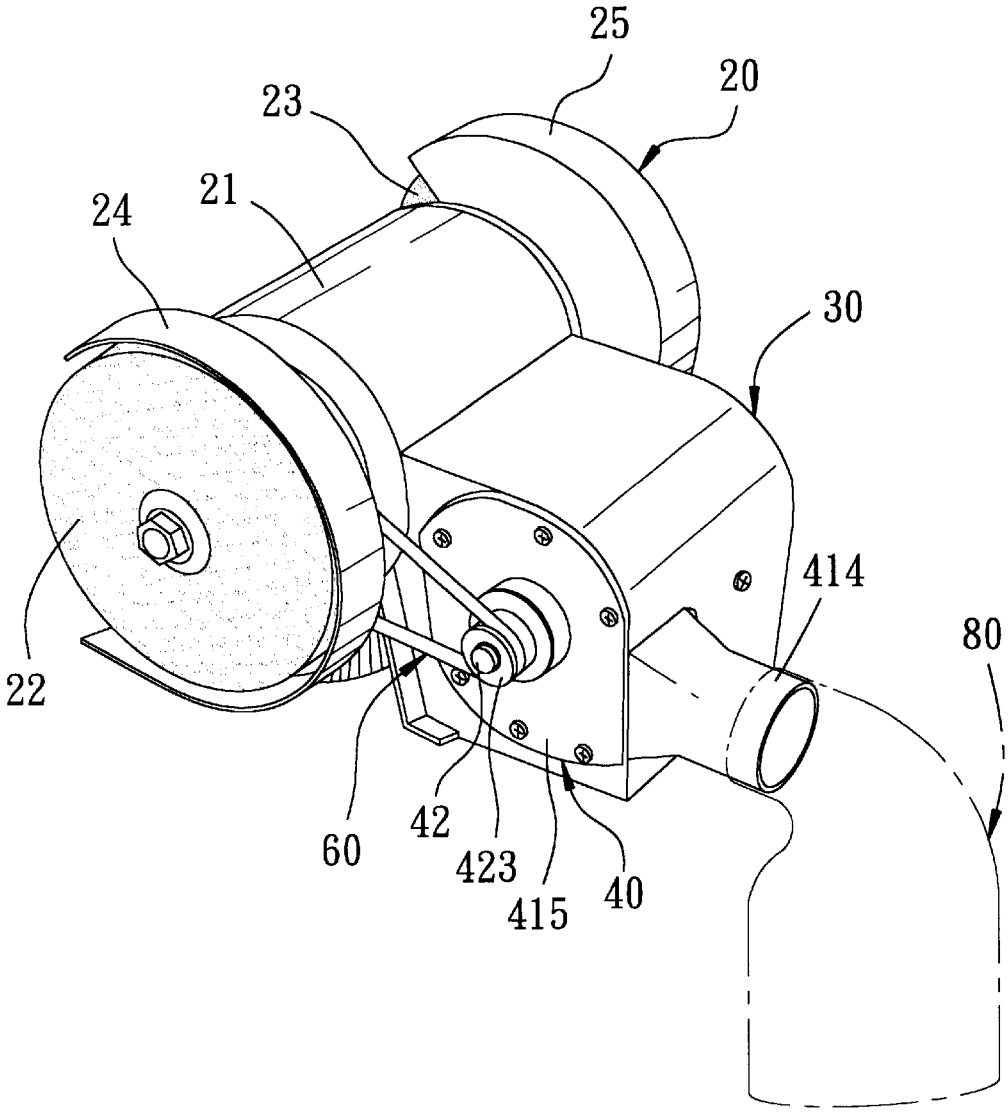
FIG. 2 is a perspective view of a preferred embodiment of a grinding device according to this invention.
Figure 3:
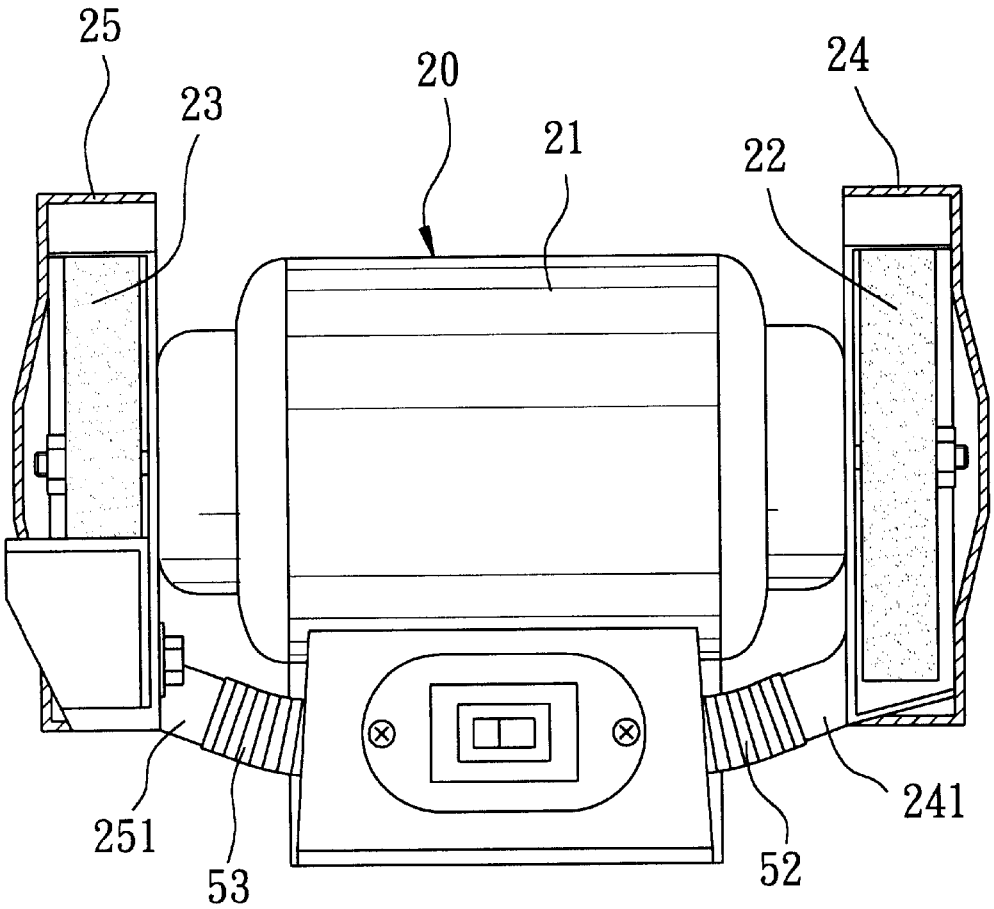
FIG. 3 is a schematic partly cutaway view showing the position of a dust collecting mechanism of the preferred embodiment.
Figure 4:
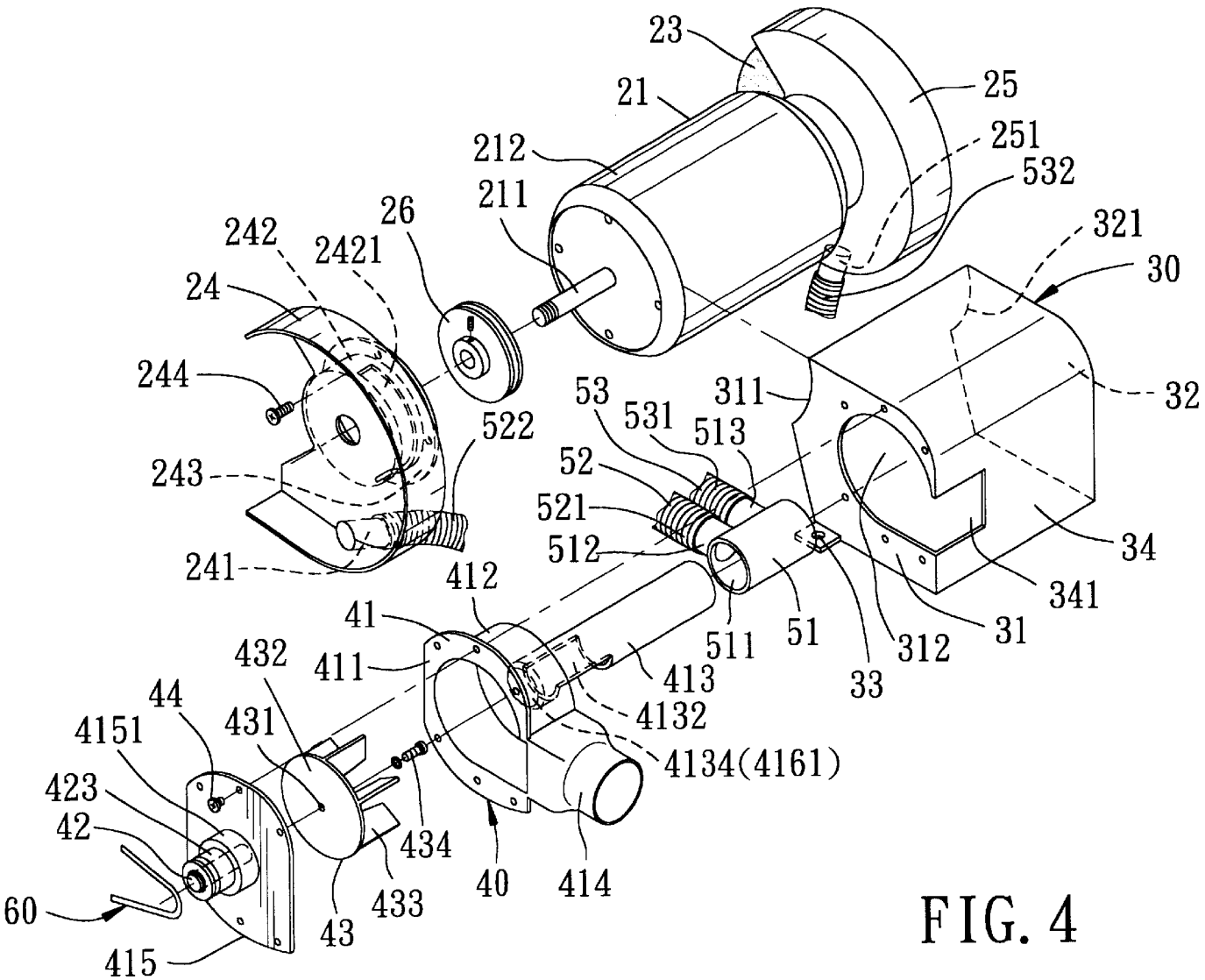
FIG. 4 is a fragmentary exploded view of the preferred embodiment.

Referring to FIGS. 2, 3 and 4, the preferred embodiment of the grinding device 20 according to the present invention is shown to comprise a motor 21 which includes a motor body 212, and an output shaft 211 to deliver a driving force. The output shaft 211 is disposed rotatably to and outwardly of the motor body 212, extends to define a first axis in a longitudinal direction, and has two ends which are outboard to the motor body 212. A grinding wheel member includes right and left grinding wheels 23,22 which are mounted to rotate with the ends of the output shaft 211 about the first axis.

A dust collecting member includes right and left dust chutes 25,24 which are disposed to surround and which are spaced apart from the right and left grinding wheels 23,22, respectively. The right and left dust chutes 25,24 respectively have right and left openings 251,241 that act as an outlet port. The left dust chute 24 further has a sleeve 242 which surrounds the first axis and which has a through hole 2421 formed therethrough, and a locking plate 243 which is secured on the motor body 212 by means of screws 244.

A housing 30 includes right and left side walls 32,31 which are spaced apart from each other in the longitudinal direction and which have arcuate concaved portions 321,311 so as to be anchored on the motor body 212, a middle plate 34 which is disposed between the right and left side walls 32,31 and which has an opening 341 adjacent to the left side wall 31 so as to confine an accommodating space, and bottom locking seats 33 which are secured on a worktable (not shown). The left side wall 31 has an opening 312 which is communicated with the opening 341.

An elongated hollow member is disposed between the dust collecting member and a blowing member 40, and includes a first tubular end, a second tubular end 4134, and a middle portion which is disposed therebetween so as to define a duct therethrough.

Figure 5:
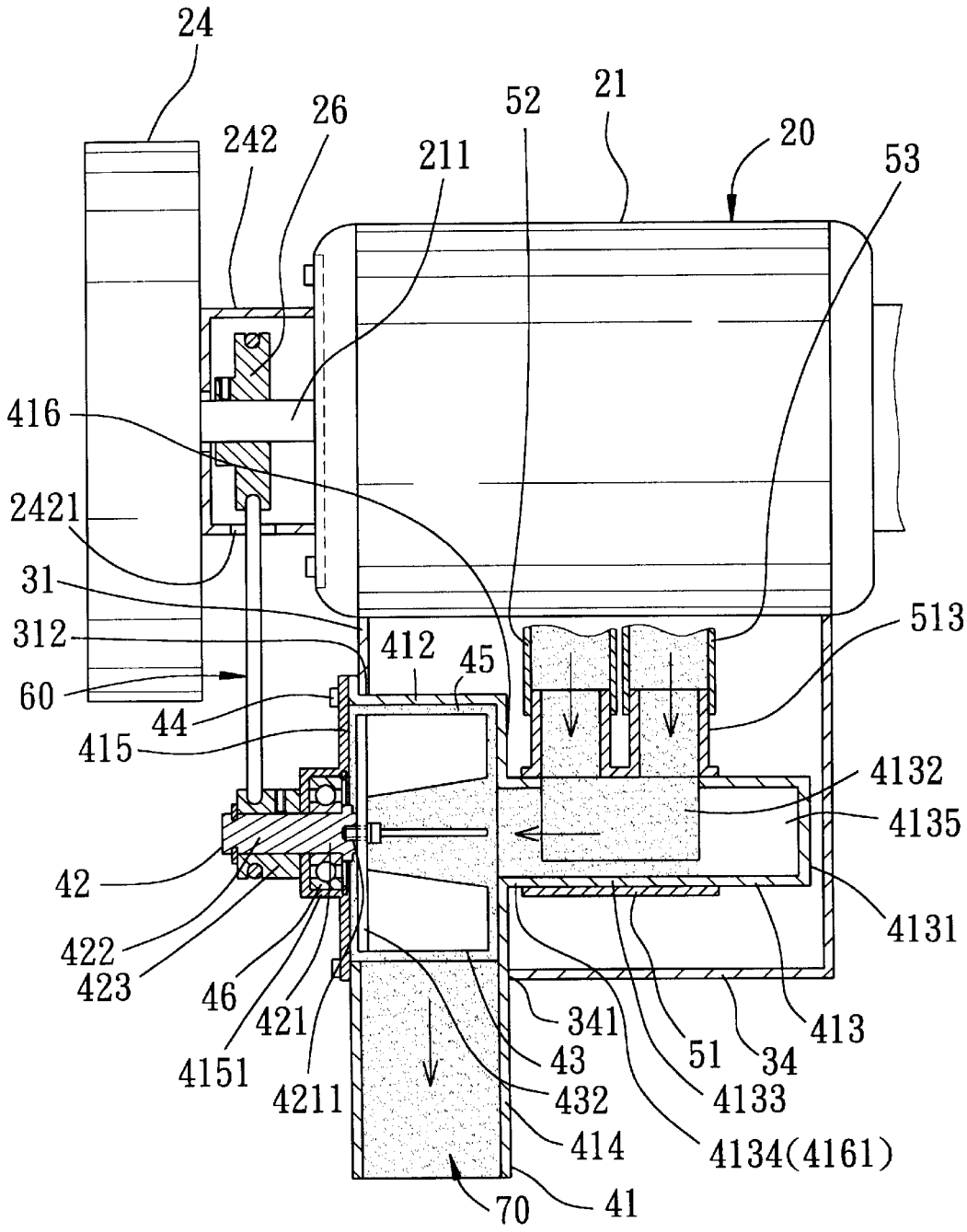
FIG. 5 is a fragmentary schematic sectional view of the preferred embodiment.

With reference to FIG. 5, the first tubular end includes right and left flexible tubes 53,52 which are respectively connected to and which are communicated with the right and left openings 251,241 at first ends 532,522 thereof. The middle portion is received in the accommodating space of the housing 30, and includes an elongated guiding tube 413 and a sleeve tube 51. The guiding tube 413 extends along a second axis parallel to the first axis, and has a closed end 4131, an open end 4133 which is disposed opposite to the closed end 4131 in the longitudinal direction and which is connected to the second tubular end 4134 to confine a passage 4135, and an opening 4132 which is formed between the closed and open ends 4131,4133 and which extends radial to the second axis. The sleeve tube 51 has a surrounding wall 511 which is sleeved securely on the guiding tube 413. The surrounding wall 511 has two port portions 513,512 which extend therethrough radial to the second axis and which are connected to and which are communicated with second ends 531,521 of the right and left flexible tubes 53,52. Thus, the port portions 513,512 are disposed to communicate with the opening 4132 of the guiding tube 413 such that dust 70 is guided from the dust chutes 25,24 into the passage 4135 via the right and left flexible tubes 53,52 and the sleeve tube 51.

The blowing member 40 includes a casing 41 and an impeller 43. The casing 40 is inserted into the housing 30 via the opening 312, and has proximate and distal walls 411,416 which are spaced apart from each other in the longitudinal direction and which are respectively proximate and distal to the right side wall 32 of the housing 30, and a surrounding wall 412 which is disposed between the walls 411,416 to confine an accommodating chamber 45. A discharge port 414 is disposed on the surrounding wall 412, and extends radial to the second axis. The distal wall 416 is provided with an inlet port 4161 which is connected to and which is communicated with the second tubular end 4134 of the hollow member. The proximate wall 411 and a cover plate 415 are secured on the left side wall 31 by means of screws 44. A bearing seat 4151 is disposed on the cover plate 415 and has a bearing 46 mounted therein.

A rotating shaft 42 extends along the second axis, and includes inner and outer ends 421,422 which are disposed opposite to each other in the longitudinal direction. The inner end 421 is rotatably mounted in and extends through the bearing seat 4151. The outer end 422 extends outwardly of the bearing seat 4151. A drive transmission member includes a drive pulley 26 which is received in the sleeve 242 and which is mounted on and which is rotated with the left end of the output shaft 211, a driven pulley 423 which is mounted on and which is rotated with the outer end 422 of the rotating shaft 42, and a belt 60 which is trained on the drive and driven pulleys 26,423 to transmit the driving force of the output shaft 211 to the rotating shaft 42 such that the rotating shaft 42 is rotatable about the second axis when the motor 21 is actuated.

The impeller 43 is received in the accommodating chamber 45, and includes a connecting plate 432 which is secured on the inner end 421 of the rotating shaft 42 by a screw 434 that passes through a hole 431 and that engages threadedly a screw hole 4211 in the inner end 421 so as to be driven by the inner end 421 to rotate a plurality of fins 433 on the connecting plate 432 about the second axis. Thus, when the motor 21 is actuated during a grinding operation, dust 70 can be drawn from the dust chutes 25,24 to the accommodating chamber 45 via the duct of the hollow member and out of the discharge port 414. Preferably, referring to FIG. 2, a dust bag 80 is disposed to be connected to the discharge port 414.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A grinding device comprising:

a motor with an output shaft to deliver a driving force, said output shaft defining a first axis and extending in a longitudinal direction;

a grinding wheel member mounted to rotate with said output shaft about the first axis;

a rotating shaft defining a second axis parallel to the first axis, and having inner and outer ends opposite to each other in the longitudinal direction;

a drive transmission member disposed to transmit the driving force of said output shaft to said outer end of said rotating shaft;

a dust collecting member disposed in the vicinity of and spaced apart from said grinding wheel member to collect dust, and having an outlet port;

an elongated hollow member defining a duct therethrough, and having a first tubular end which is connected to said dust collecting member such that said duct is communicated with said outlet port, a second tubular end, and a middle portion which is disposed between said first and second tubular ends; and a blowing member including a casing having proximate and distal walls which are spaced apart from each other in the longitudinal direction and which are respectively proximate and distal to said rotating shaft to confine an accommodating chamber, and a discharge port which is disposed between said proximate and distal walls and which extends radial to the second axis, said distal wall being provided with an inlet port which is connected to and which is communicated with said second tubular end of said hollow member, said proximate wall being mounted on said inner end of said rotating shaft to permit rotation of said inner end relative thereto, and an impeller received in said accommodating chamber, and driven by said inner end of said rotating shaft to rotate about the second axis so as to draw dust from said dust collecting member to said accommodating chamber via said duct and out of said discharge port.

2. The grinding device of claim 1, wherein said middle portion of said hollow member includes an elongated guiding tube extending along the second axis, and having a closed end, an open end which is disposed opposite to said closed end in the longitudinal direction and which is connected to said second tubular end to confine a passage, and an opening which is formed between said closed and open ends and which extends radial to the second axis, and a sleeve tube having a surrounding wall which is sleeved securely on said guiding tube, said surrounding wall having a port portion which extends therethrough radial to the second axis and which is communicated with said first tubular end of said hollow member, said port portion being disposed to communicate with said opening of said guiding tube such that dust is guided from said dust collecting member into said passage via said opening.

3. The grinding device of claim 2, wherein said first tubular end of said hollow member is made of a flexible material.

4. The grinding device of claim 2, wherein said motor further includes a motor body, said output shaft being disposed rotatably to and outwardly of said motor body, said grinding device further comprising a housing disposed to be anchored on said motor body, and having right and left side walls which are spaced apart from each other in the longitudinal direction and which are respectively distal and proximate to said rotating shaft to confine an accommodating space for receiving said middle portion of said hollow member and said blowing member, said proximate wall of said casing being secured to said left side wall such that said rotating shaft is disposed outwardly of said left side wall.

5. The grinding device of claim 4, wherein said output shaft has two ends opposite to each other in the first axis and outboard to said motor body, said grinding wheel member including right and left grinding wheels respectively mounted on said ends of said output shaft, said dust collecting member including right and left dust chutes which are respectively disposed to surround and which are spaced apart from said right and left grinding wheels and which respectively have right and left openings acting as said outlet port, said first tubular end of said hollow member including right and left flexible tubes which are respectively connected to and which are communicated with said right and left openings.

6. The grinding device of claim 1, wherein said drive transmission member includes a drive pulley mounted to rotate with said output shaft, a driven pulley mounted to rotate with said outer end of said rotating shaft, and a belt trained on said drive and driven pulleys to transmit the driving force of said output shaft to said rotating shaft.

* * * * *